US007036650B2

(12) United States Patent
Brugger et al.

(10) Patent No.: US 7,036,650 B2
(45) Date of Patent: May 2, 2006

(54) SHEET ACCEPTING APPARATUS AND RECYCLER

(75) Inventors: Robert Brugger, Bern (CH); Pierre-Yves Monneron, Niederwangen (CH); Daniel Wyss, Bern (CH); Matthew Price, Neyruz (CH)

(73) Assignee: De La Rue International LTD, Basingstroke (GB)

( * ) Notice: Subject to any disclaimer, the term of this patent is extended or adjusted under 35 U.S.C. 154(b) by 189 days.

(21) Appl. No.: 10/480,926

(22) PCT Filed: Aug. 7, 2002

(86) PCT No.: PCT/GB02/03661

§ 371 (c)(1),
(2), (4) Date: Jan. 21, 2004

(87) PCT Pub. No.: WO03/013994

PCT Pub. Date: Feb. 20, 2003

(65) Prior Publication Data

US 2005/0006199 A1 Jan. 13, 2005

(30) Foreign Application Priority Data

Aug. 7, 2001 (GB) ..... 0119261.6
Mar. 6, 2002 (GB) ..... 0205274.4

(51) Int. Cl.
*B07C 5/00* (2006.01)
*G07C 7/04* (2006.01)

(52) U.S. Cl. ..... 194/206; 194/347; 209/534

(58) Field of Classification Search ..... 194/206, 194/202, 302, 342, 343, 347; 209/534, 576, 209/577, 581, 587, 588
See application file for complete search history.

(56) References Cited

U.S. PATENT DOCUMENTS

| | | | | |
|---|---|---|---|---|
| 4,883,181 | A | 11/1989 | Yoshikawa | |
| 4,971,310 | A | 11/1990 | Motegi et al. | |
| 5,156,250 | A * | 10/1992 | Parish et al. | 194/348 |
| 5,199,697 | A * | 4/1993 | Yamada et al. | 271/122 |
| 5,295,675 | A | 3/1994 | Hain | |
| 5,988,345 | A | 11/1999 | Bergeron et al. | |
| 2002/0060421 | A1 | 5/2002 | Kako et al. | |

FOREIGN PATENT DOCUMENTS

| | | |
|---|---|---|
| EP | 0 389 733 | 10/1990 |
| EP | 0 714 078 A1 | 5/1996 |
| EP | 0 967 581 A2 | 12/1999 |
| JP | A 62-125489 | 6/1987 |
| JP | 01044590 | 2/1989 |
| JP | 05028345 | 2/1993 |
| JP | 08010709 | 1/1996 |
| JP | 9-62896 A * | 3/1997 |

* cited by examiner

*Primary Examiner*—Donald P. Walsh
*Assistant Examiner*—Mark J. Beauchaine
(74) *Attorney, Agent, or Firm*—Oliff & Berridge, PLC

(57) ABSTRACT

A sheet accepting apparatus comprises an inlet (210) for receiving one or more sheets. A transport system (217,350) extracts sheets from the inlet. A first detector (222) detects the passage of a foreign object with the transported sheet(s), the transport system being controllable to divert a detected foreign object to a foreign object collection position (215). One or more further detectors monitor sheets fed by the transport system. At least one store (205) is provided for storing accepted sheets. A controller is responsive to the detectors for controlling the transport system.

28 Claims, 13 Drawing Sheets

Fig.(5D).

SHEET ACCEPTING APPARATUS AND RECYCLER

The invention relates to sheet accepting apparatus and to a sheet recycler incorporating such an accepting apparatus, particularly for accepting documents of value such as banknotes.

Banknote acceptors and recyclers are well known and in a typical construction, a banknote is inserted through an inlet aperture and is then passed through one or more detectors for detecting the authenticity and/or denomination of the banknote following which the banknote is either stored or returned to the user. A problem which can arise with such acceptors, particularly when used in unsupervised situations, is the presence of foreign objects is attached to or located between adjacent sheets. Foreign objects include coins, credit cards, paperclips and the like. If such foreign objects pass into the transport system of the acceptor, there is a risk of jamming or even damage to the transport components with the result that the machine must be opened up to remove a foreign object and may have to be repaired.

In accordance with a first aspect of the present invention, a sheet accepting apparatus comprises an inlet for receiving one or more sheets; a transport system for extracting sheets from the inlet; a first detector for detecting the passage of a foreign object with the transported sheet(s), the transport system being controllable to divert a detected foreign object to a foreign object collection position; one or more further detectors for monitoring sheets fed by the transport system; at least one store for storing accepted sheets; a diverter for diverting unacceptable sheets to an output location; and a controller responsive to the detectors for controlling the transport system.

We have devised a new sheet acceptor in which the transport system is designed to extract sheets from the inlet including a foreign object which is then subsequently detected and diverted to the foreign object collection position in a controlled manner thus minimizing the risk of damage or jamming.

The foreign object collection position may be located internally of the apparatus so that the foreign objects are held securely within the apparatus but in most cases it is preferred that the foreign object collection position is accessible to the user. This enables the user to retrieve the foreign object which may be valuable such as a credit card or a document of value to which the foreign object is attached. Conveniently, the foreign object collection position is located adjacent the inlet so that the user can easily retrieve the foreign object.

Although the transport system could be arranged to deal with all foreign objects, preferably the inlet is defined by an inlet hopper having at least one opening through which foreign objects can fall into a, preferably the same, foreign object collection position. This provides a convenient way of handling relatively heavy foreign objects such as coins.

The foreign object collection position may comprise a fixed hopper in which foreign objects collect and which is periodically emptied either by the user or in response to regular maintenance but since the foreign object might be attached to a document of value, preferably a conveyor system is provided at the foreign object collection position on which foreign objects collect, the conveyor system being operable to feed foreign objects to a secure store. This enables the apparatus to deal with a foreign object which, for some reason, is not removed by the user.

The transport system could be designed in a variety of ways to deal with the foreign object. For example, the controller could cause the transport system simply to reverse its feed direction so that upon the detection of a foreign object, the foreign object is immediately reversed back to the inlet, the inlet constituting the foreign object collection position. In another example, a diverter could be incorporated so as to cause the foreign object while being actively fed forward by the transport system to be diverted to the foreign object collection position.

A typical approach to dealing with foreign objects is to cause the sheet to be folded around a bend. A relatively inflexible foreign object will not fold and this property is used to cause a switch to be actuated. This is a relatively crude approach to detecting foreign objects and by forcing the foreign object around a curve, there is a risk of jamming while, of course, if the foreign object is flexible then it will not be detected.

In the preferred arrangement, therefore, the transport system defines a first feed system for extracting sheets from the inlet and a second feed system downstream of the first feed system for receiving sheets from the first feed system and for feeding them on to a further downstream location, whereby the second feed system defines a planar path such that foreign objects are substantially not bent as they are fed by the second feed system, the second feed system being pivotally mounted such that when a foreign object is detected, the controller causes the second feed system to pivot so that the foreign object is fed to the foreign object collection position.

Thus, in accordance with a second aspect of the present invention, a sheet accepting apparatus comprises an inlet for receiving one or more sheets; a transport system including a first feed system for extracting sheets from the inlet, the first feed system including a first detector for detecting the passage of a foreign object through the first feed system and a second feed system downstream of the first feed system for receiving sheets from the first feed system and for feeding them on to a further downstream location, whereby the second feed system defines a planar path such that sheets are substantially not bent as they are fed by the second feed system; and a controller connected to the first detector and the second feed system, the second feed system being pivotally mounted such that when a foreign object is detected, the controller causes the second feed system to pivot so that the foreign object is fed to a reject location.

In this new sheet accepting apparatus, the sheets are maintained in a substantially planar, flat form and if they have to be rejected due to the presence of a foreign object, they are maintained in the flat form, the second feed system pivoting appropriately following which the sheet and foreign object are fed to the reject location.

The second feed system could be pivotably mounted at any point along its length but conveniently the second feed system is pivotally mounted at its downstream end with respect to the first feed system, the controller causing the second feed system to reverse its feed direction when feeding a foreign object to the reject location. The advantage of this is that the reject location can be provided adjacent the inlet, such as an input hopper, thus allowing rejected sheets and foreign objects to be conveniently retrieved by the user.

The second feed system could be constructed in any conventional manner using rollers or, preferably, juxtaposed feed belts.

The presence of a foreign object could be detected in a variety of ways. For example, an optical scan could be made of the "sheets" as they are fed to the second feed system but conveniently the detector system includes at least one roller of the first feed system, and a sensor for monitoring displacement of the at least one roller.

The first detector needs to be able to distinguish between the passage of an acceptable, single sheet and the passage of a foreign object. Conveniently, therefore, the first detector comprises at least two laterally spaced rollers of the first feed system, and respective sensors for monitoring displacement of each roller. This enables differences in the thickness of the "sheet" in a lateral direction to be determined which will normally indicate the presence of a foreign object.

The first detector could also be used to sense for the passage of a multiple sheet feed which will generally also be unacceptable and require a reject operation although in some cases might be accepted depending upon the application.

The transport system must be designed so that at the inlet it can accept a foreign object without jamming or damage. This could be achieved by utilizing a relatively soft feed roller which can absorb different thicknesses but in the preferred example, at the inlet, the transport system includes at least one roller defining a feed nip with another surface and which is biased in a direction to close the nip but which can be urged against the bias during passage of a foreign object.

As well as dealing with foreign objects, the sheet accepting apparatus according to the first aspect of the invention also includes one or more further detectors for monitoring the sheets, particularly to determine their acceptability. This might be to ensure that they are sheets of a type which can be handled and/or they are authentic. Although the transport system could simply reverse if the detection is not satisfactory, preferably the transport system includes a diverter for diverting unacceptable sheets to an output location. The output location could be constituted by the inlet and/or the foreign object collection position but preferably is separate from these but located adjacent the inlet.

The one or more further detectors can be of any conventional type including pattern, size, magnetic, UV, thickness, stiffness detectors and the like.

The store can also be of any conventional type including a cassette into which the sheets are stacked by a stacking wheel or other stacking device but preferably comprises a roll storage module. This latter form of store is particularly suited when the sheet accepting apparatus forms part of a recycler.

Thus, in accordance with a third aspect of the present invention, a sheet recycler comprises a sheet acceptor according to the first aspect of the invention; and an output assembly to which sheets are fed from the store by the transport system, the output assembly being adapted to present the sheets at an output location. The output location is conveniently located adjacent the inlet and/or foreign object collection position.

Each of the input, foreign object collection, and output locations may be normally covered by a respective door which is retractable in use to allow access.

The output assembly typically includes a tray on which the sheets are stacked and this may be located at the output location. Preferably, however, the tray is movable from a stacking position to an output location.

The tray may be movable by a variety of means such as a conveyor belt to which the tray is attached, but in the preferred arrangement, the tray is supported on laterally spaced tracks along which it can be moved between the stacking position and the output location.

In some cases, a stack of sheets may not be collected by the user, typically due to an oversight. Before further sheets can be dispensed, the previous sheets need to be removed and thus preferably the tray is pivotally mounted to enable stacked sheets to be fed into a secure store. Where the tray is movable between a stacking position and the output location, the recycler preferably further comprises a diverting member actuable to cause the tray to pivot during movement of the tray from the output location towards the stacking position.

In order to achieve compactness and to allow foreign objects in the foreign object collection position to be stored securely, particularly if they are not retrieved by the user, preferably the foreign object conveyor is pivotable between the tracks of the tray.

In order to allow a user to agree the value of banknotes or other documents of value deposited, the recycler preferably further comprises an escrow store to which accepted sheets are initially fed by the transport system. Once agreed, the sheets will be fed from the escrow store to the final store.

The apparatus according to the first and second aspects of the invention deals with the presence of foreign objects after they have been fed by the first feed system into the second feed system. In many cases, it will be preferable to avoid foreign objects reaching the first feed system in the first place. Thus, in accordance with a fourth aspect of the present invention, a sheet feed assembly comprises an input hopper for receiving one or more sheets; and a first feed system for extracting sheets from the input hopper, the input hopper having at least one opening through which foreign objects deposited in the input hopper can fall.

We have found that in many cases sheets, particularly banknotes, may be mixed up with loose foreign objects such as coins, keys and the like and these can be separated out while the sheets are present in the input hopper, the loose objects simply falling through the opening.

This can be enhanced by including a pusher member in the hopper for pushing sheets away from a base of the input hopper so as to be correctly presented to the first feed system. As the sheets are pushed away from the base, typically in a direction with an upward component, loose objects will fall under gravity away from the sheets and through the opening.

As mentioned above, sheet accepting apparatus according to the invention can be used in a wide variety of applications including banknote deposit machines, vending machines and the like.

Some examples of sheet accepting apparatus and recyclers according to the present invention will now be described with reference to the accompanying drawings, in which.

Figure 1:
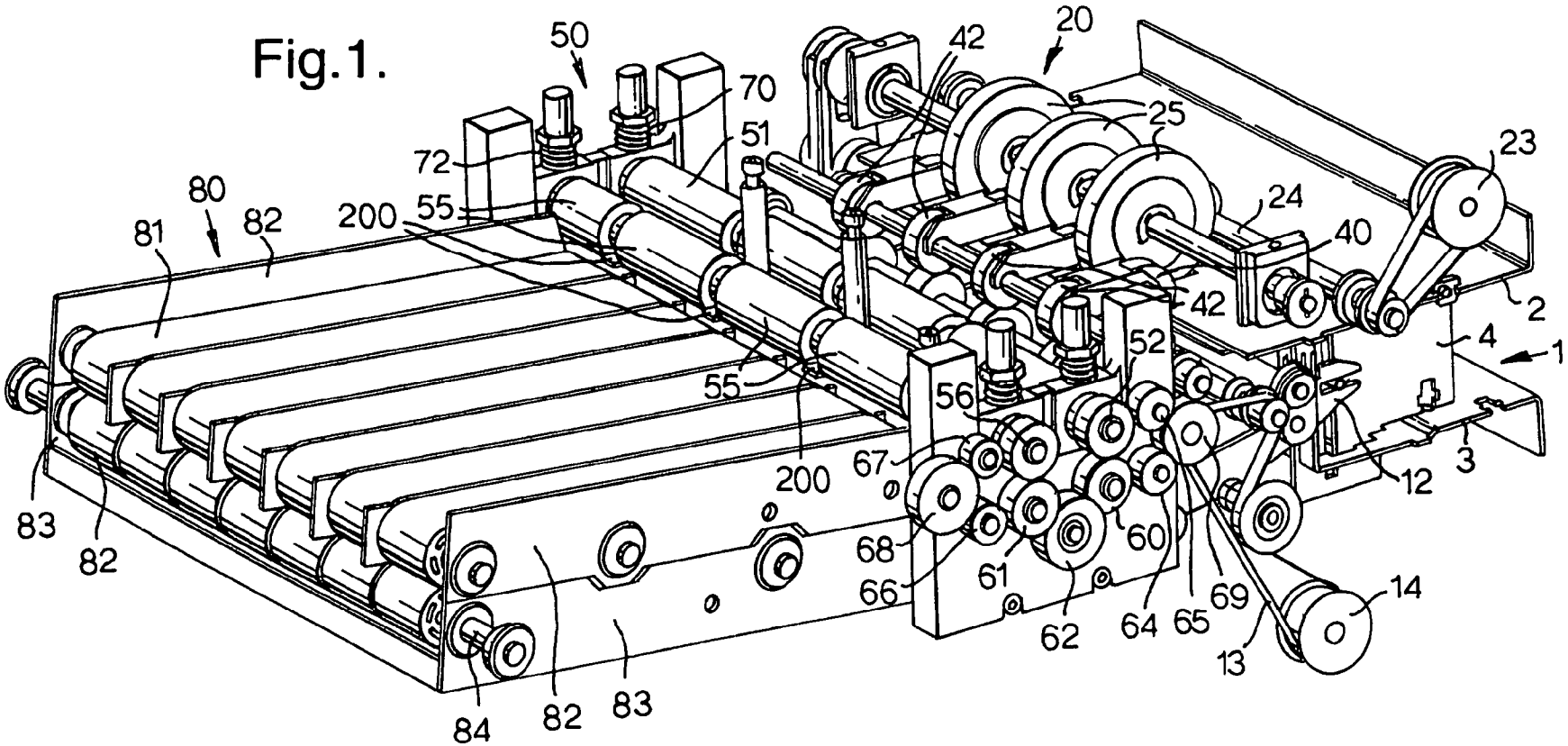
FIG. 1 is a perspective view of a first example of sheet accepting apparatus with some parts omitted for clarity and showing the second feed system in its normal, feed position.
Figure 2:
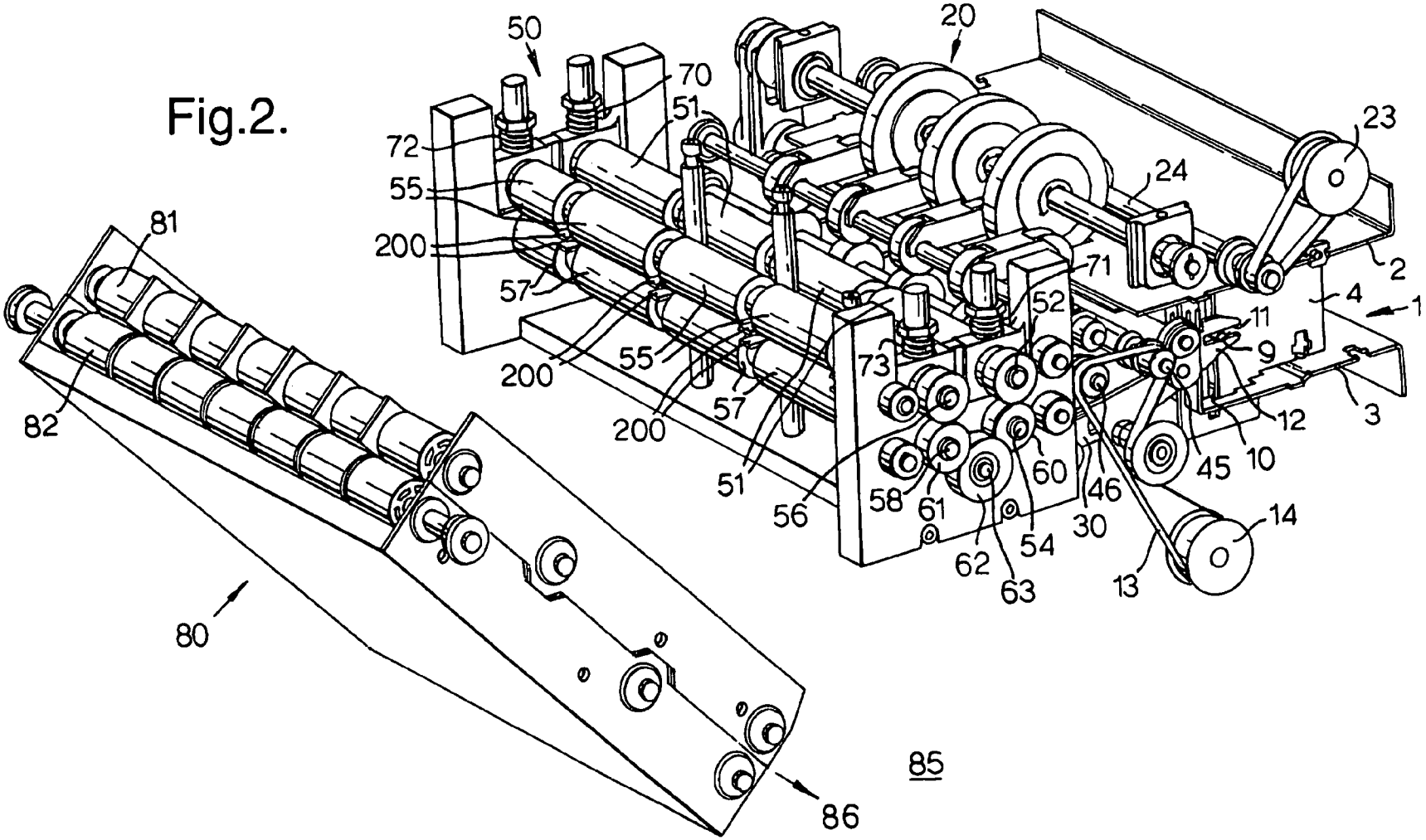
FIG. 2 is a view similar to FIG. 1 but showing the second feed system in its reject position and omitting some gears shown in FIG. 1.
Figure 3:
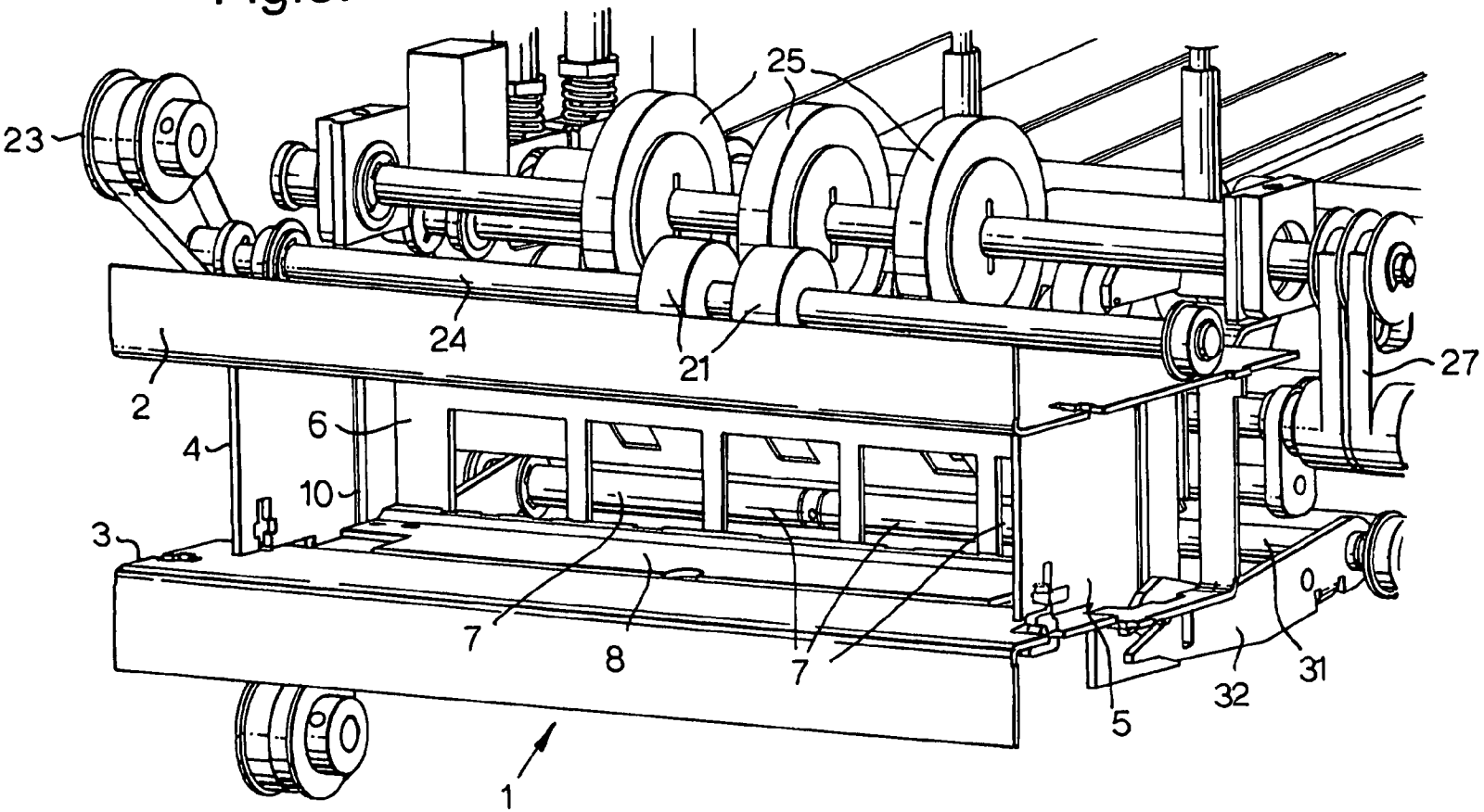
FIG. 3 is a perspective view of the input hopper and first feed system of the assembly.

The sheet accepting apparatus shown in FIGS. 1–7 comprises an input hopper 1 defined by upper and lower plates 2,3 and side plates 4,5. The input hopper 1 has a back plate 6 with a set of large apertures 7. A pusher plate 8 is shown in its rest position in FIG. 3 flush with the lower plate 3 of the input hopper 1. The pusher plate is connected to a pin 9 extending laterally outwardly through a slot 10 in the plate 4 where it is received in a slot 11 of fork 12.

Figure 7:
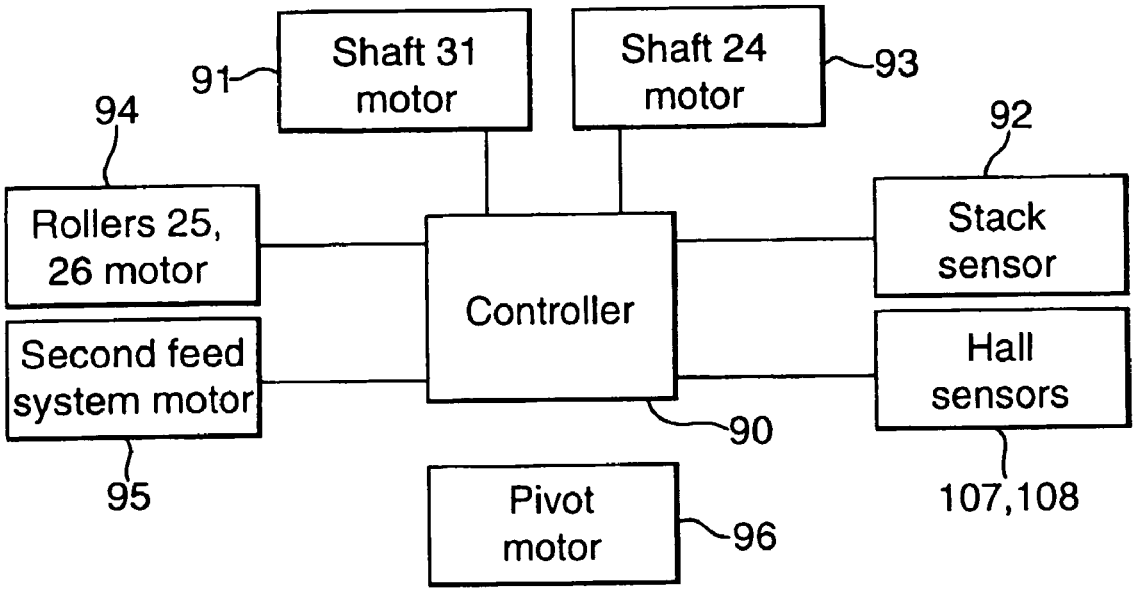
FIG. 7 is a block diagram of the control components.
Figure 8:
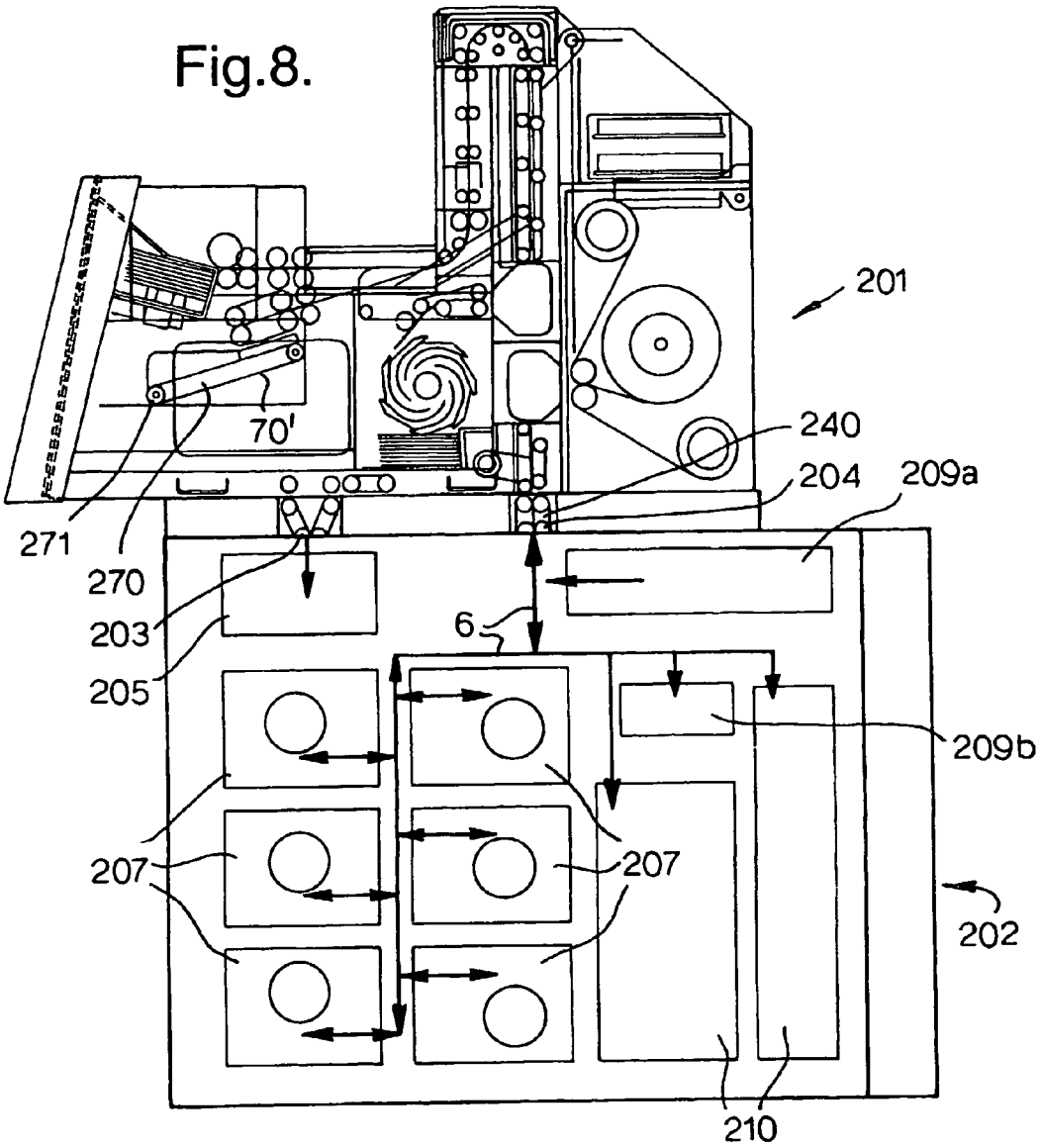
FIG. 8 is a schematic side view of a recycler.

The fork 12 is formed at the end of a lever arm 30 coupled to a shaft 31 which can be rotated to move the fork 12 upwards. A corresponding arm 32 is mounted to the other end of the shaft 31 with a shaped pin being used to prevent rotation of the pusher plate. Rotation of the shaft 31 is controlled by a motor 91 connected to a controller 90 (FIG. 7).

Figure 4:
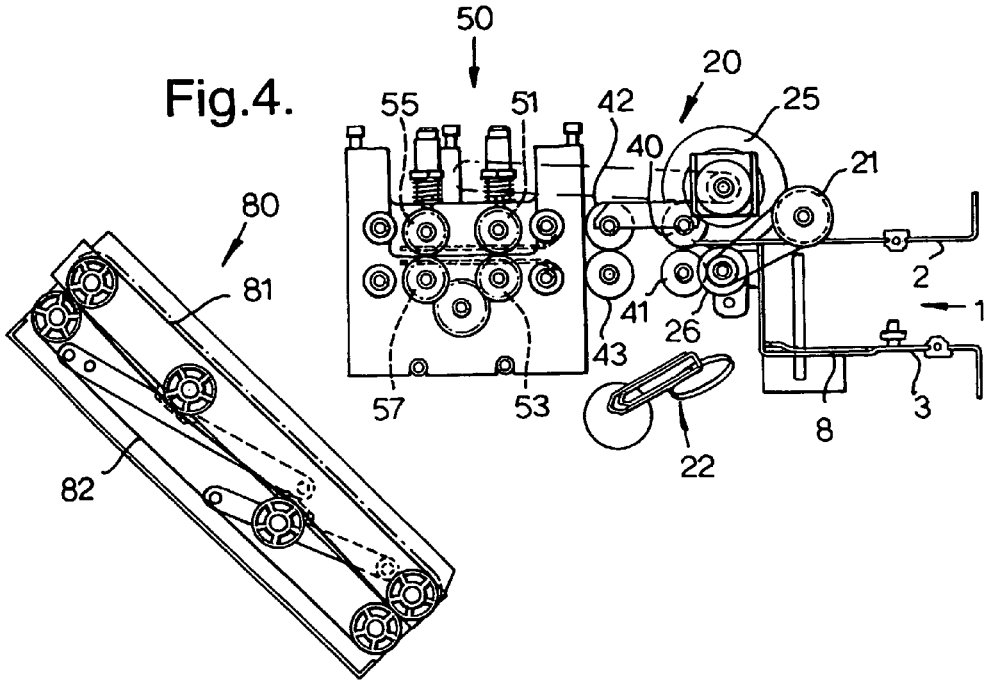
FIG. 4 is a side view of the apparatus of FIG. 1 with the second feed system in its reject position.

Once a stack of sheets has been placed in the input hopper 1, the user will indicate this to the controller 90 and the controller will activate the motor 91 to move the pusher plate 8 upwards towards the upper plate 2. This will raise the stack of sheets until the uppermost sheet contacts a pair of feed rollers 21 of a first feed system 20 which is sensed by a sensor 92. As the sheets are moved upwardly, any loose, foreign objects 22 are allowed to fall through the openings 7 into a foreign object outlet as seen in FIG. 4 or can simply be removed by hand from the input hopper.

A motor 93 coupled with a drive pulley 23 is then activated to rotate a shaft 24 on which the rollers 21 are non-rotatably mounted. This draws the topmost sheet away from the stack and into a nip defined between a set of rollers 25 and cooperating, reverse driven separation rollers 26 (FIG. 4). The rollers 25 are flexibly mounted. The rollers 25,26 are driven by a motor 94 via a drive pulley 14 and drive belts 13,27. The rollers 26 assist in removing foreign objects by feeding them back to the input hopper.

The sheets are then fed between nips defined by opposed pairs of rollers 40,41 and 42,43, the rollers 41,43 being mounted non-rotatably to shafts 45,46 driven via the drive pulley 14.

The sheets then enter a sheet thickness detection system 50 forming part of the first feed system 20.

The detection system 50 comprises a set of four upper rollers 51 mounted rotatably on a shaft 52 and cooperating with a corresponding set of lower rollers 53 (FIG. 4) non-rotatably mounted on a shaft 54. Of course, any number of upper and lower roller pairs could be used.

A second set of upper rollers 55 are rotatably mounted on a shaft 56 and cooperate with lower rollers 57 non-rotatably mounted on a shaft 58. It will be noted that the gaps between the rollers 55 are offset from the gaps between the rollers 51 to ensure that the presence of foreign objects is detected. The gaps allow for guides 200 to be inserted between the rollers.

The shafts 54,58 have respective gear wheels 60,61 non-rotatably mounted on their ends, these gear wheels contacting an idler gear 62. Idler gears 68 and 69 contact gears 64 and 65 and gears 66 and 67, which applies drive to shafts 52 and 56. Shaft 54 is coupled to a separate motor not shown.

The shafts 52,56 are urged towards the shafts 54,55 by springs 70–73. As sheets pass between the sets of rollers, the upper rollers 51,55 will be urged upwardly against the spring action. This movement is sensed by sensors associated with the ends of each shaft 52,56, the information being used as will be explained in more detail below.

Figure 6:
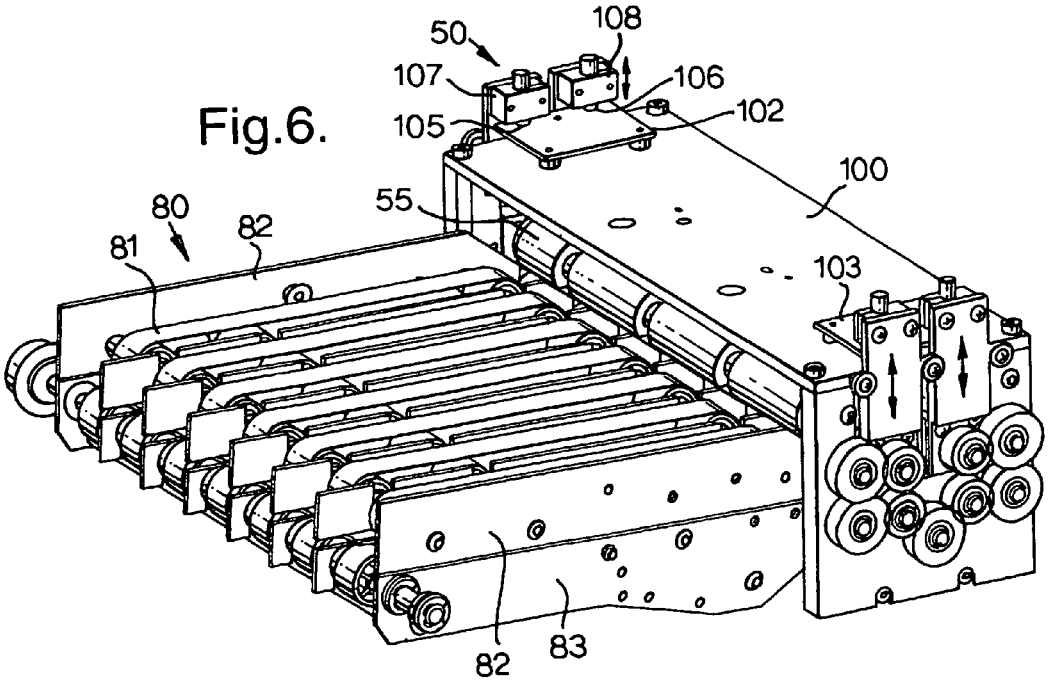
FIG. 6 is a view similar to FIG. 1 but showing certain other components.

FIG. 6 illustrates part of the apparatus of FIG. 1 from which it will be seen that a metal plate 100 (not shown in FIGS. 1 and 2) extends across the rollers 51,55, a pair of electronic boards 102,103 being secured to the plate 100. Each board 102,103 carries a pair of magnets 105,106 which are aligned with respective hall sensors 107,108 coupled for up and down movement with the rollers 55,51 respectively. Only the hall sensors on one side of the apparatus can be seen in FIG. 6.

Initially, the sheets from the detection system 50 will be fed into a second feed system 80 in its orientation shown in FIG. 1. The second feed system comprises sets of upper and lower drive belts 81,82 laterally spaced between end plates 82,83 respectively. The second feed system 80 is pivoted to outer support plates (not shown) via a shaft 84.

The drive belts 81,82 are driven at the same speed as the rollers of the first feed system 20 so that sheets pass smoothly into the second feed system. The second feed system 81,82 coupled to shaft 84 is driven by a motor 95.

If the detection system 50 determines that a single sheet has been fed in an acceptable manner, the second feed system 80 will continue feeding the sheets in a forward direction onto a downstream location such as a sheet store or other detection systems. However, if the sheet is found to be unacceptable, for example due to the presence of a foreign object, the motor driving the rollers 21 will be stopped to prevent any further sheets from being fed into the first feed system and the motor 95 driving the second feed system 80 will also be stopped so that the sheet is held in a relatively flat state between the drive belts 81,82 but not protruding. The second feed system is pivoted, typically automatically by actuation of a motor 96, about the shaft 84 to the position shown in FIGS. 2 and 4 and the drive belts 81,82 are then driven in the reverse direction so that the sheets are fed out to a reject location 85 in a direction 86.

FIG. 5 illustrates how the controller 90 can distinguish between different types of sheet as they are fed through the detection system 50. For simplicity, the movement of the shaft 52 at each end (i.e. as reflected by the compression of the springs 70,71) is illustrated in FIG. 5.

Figure 5A:
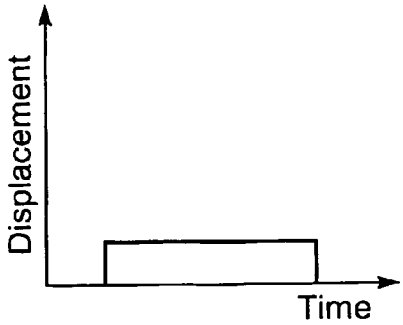
FIG. 5 illustrates the displacement of the sheet thickness detection rollers under different conditions.
Figure 5B:
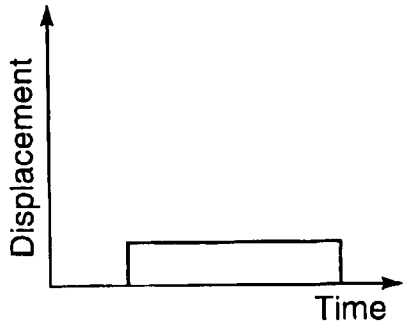

FIGS. 5A and 5B illustrate the displacement of each end of the shaft 52 during the passage of a single sheet. As can be seen, the displacement rapidly rises to a value corresponding to the thickness of the sheet which then remains constant until the sheet leaves the detection system. The displacement will be substantially the same at both ends of the shaft 52.

Figure 5C:
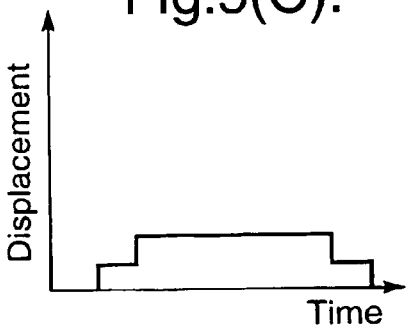
Figure 5C:
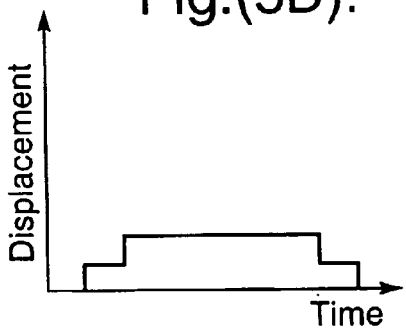

FIG. 5C and FIG. 5D illustrate displacement during the passage of a double sheet. In this case, the sheets are partially overlapped. Thus, initially, the ends of the shaft 52 will be displaced by an amount corresponding to a single sheet. As the second sheet arrives, the ends will be further displaced and for a while this displacement will remain constant. As the trailing end of the first sheet leaves the detection system, the displacement will return to that corresponding to a single sheet and then finally to zero. Again, the displacement of each end will follow a similar pattern.

Figure 5E:
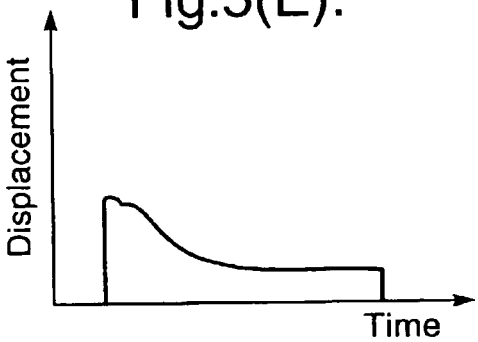
Figure 5F:
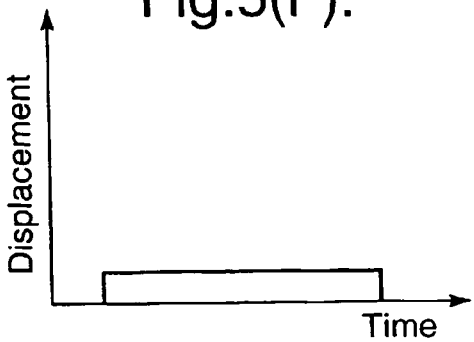

FIGS. 5E and 5F illustrate the displacement of the ends of the shaft during the passage of a sheet having a foreign object such as a paperclip attached to its leading end adjacent its edge nearest the spring 70. In this case, the foreign object will not be detected at the end of the shaft 52 adjacent the spring 71 which will indicate the passage of a single sheet (FIG. 5F). However, the other end of the shaft 52 adjacent the spring 70 will initially undergo a substantial displacement as shown in FIG. 5E corresponding to the passage of the paperclip and sheet but this will then reduce back to the single sheet thickness displacement. The controller 90 can distinguish between these different conditions and operate the second feed system accordingly. This could be to reject all sheets apart from those which are correctly fed single sheets (FIGS. 5A and 5B). In some cases, however, a double sheet feed could be accepted, for example by incrementing a count by two instead of one.

As can be seen from the drawings, in practice, there are two sets of displaceable rollers and the controller 90 will monitor displacement of each of these since in some cases a narrow foreign object might not be detected by one of the sets of rollers 51,55 if it passes through a gap between them. However, the foreign object will be detected by the other set.

The banknote recycler shown in FIGS. 8 to 16 comprises a note handling module 201 mounted on top of a secure safe or Main Storage Unit (MSU) 202. The MSU 202 comprises a pair of openings 203,204. The opening 203 communicates with a collection box 5 within the MSU 202 while the opening 204 communicates with a transport system indicated diagramatically at 206, within the MSU 202, for feeding banknotes to and from a set of roll storage modules 207. A cassette 209*a* of banknotes is provided to enable these to be dispensed while a secure box 209*b* receives suspected counterfeit notes. Cassettes 210 are for overflows. The recycler is controlled by suitable controllers, two of which 208*a*,208*b* are shown, located within the MSU 202.

Figure 9:
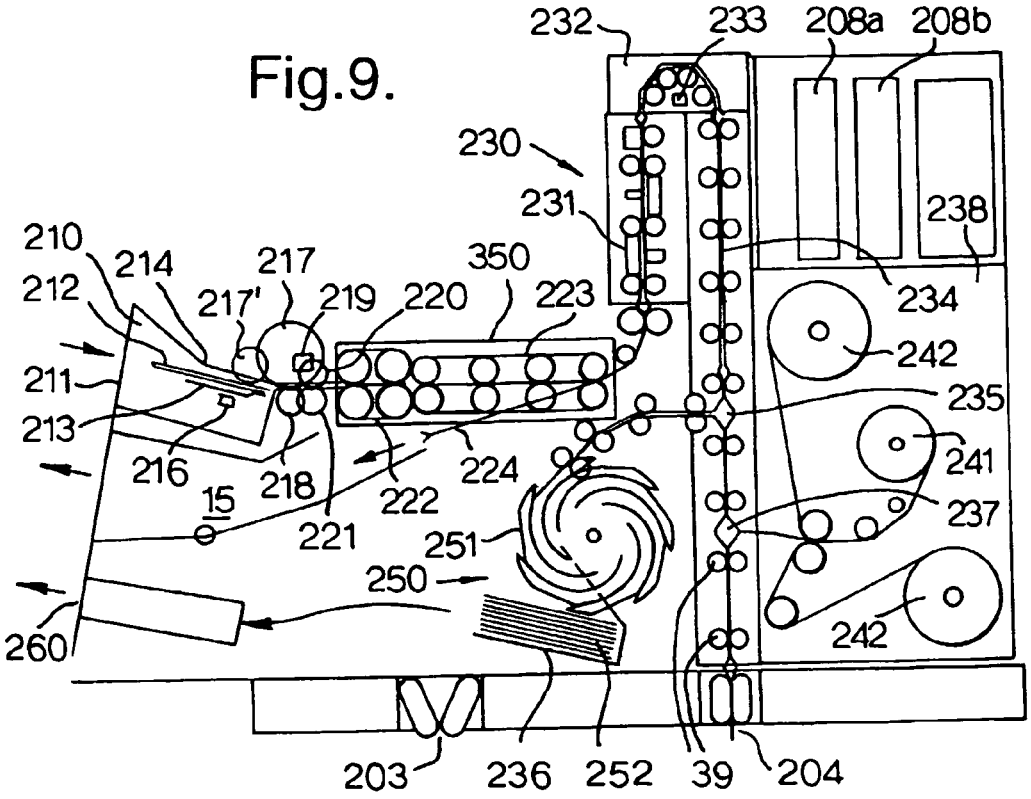
FIGS. 9 to 12 are schematic side views of the note handling module of FIG. 8 in different configurations, and with some detectors omitted for clarity in FIGS. 10 to 12.

The note handling module 201 is shown more clearly in FIG. 9. The input section is similar to the example of FIGS. 1 to 7 but will be described again here. This comprises an inlet hopper 210 having an inlet opening 211 into which a stack of banknotes 212 can be inserted. The floor 213 of the inlet hopper 210 is movably mounted so that once the stack 212 has been placed on the floor it will be raised up, as shown in FIG. 9, by a floor raising mechanism (not shown) to bring the topmost banknote in the stack into engagement with an upper wall 214 of the inlet hopper. The floor 213 has a number of apertures (not shown) through which foreign objects such as coins can fall into a foreign object collection position 215. The position 215 is accessible to the user who can collect the objects but is normally located behind a retractable door (not shown).

A detector 216, for example an optical detector, is located adjacent the inlet hopper 210 to detect the presence of banknotes in the inlet hopper.

Figure 14:
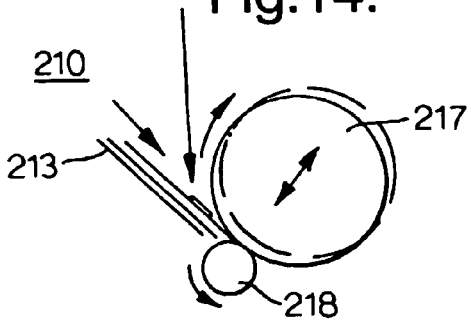
FIG. 14 illustrates the input rollers in more detail.

As in the previous example, a transport system is provided for conveying banknotes singly from the input hopper 210 through the recycler as will be described below. At the input hopper 210, the transport system includes feed roller 217 and cooperating reverse rotating roller 218 which receive the topmost banknote in the stack 212 from a nudger roller 217' and feed it past a sheet detector 219 to a foreign object detector 222 through feed nips defined by feed rollers 220,221 and then into a foreign object transport 350 defined by upper and lower conveyor belts 223. The roller 217 is spring biassed towards the roller 218 so that it can retract upon passage of a foreign object through the nip (FIG. 14).

As will be explained below, the foreign object transport 350 is pivotally mounted at its downstream end so that if a foreign object is detected, the belts 222,223 are stopped, pivoted downwardly to the position shown schematically at 224 in FIGS. 9 and 15 and then driven in reverse so that the foreign object and any attached banknote(s) is fed into the foreign object collection position 215.

If no foreign object is detected, the belts 222,223 continue to be driven in their forward direction so that the banknote is fed into a note detector module 230 where the transport path is defined by a series of feed rollers. The note detector module 230 includes a number of detectors including a pattern detector 231 connected to the controller 208*a* for obtaining information relating to the pattern on the banknote and for comparing this with patterns of genuine banknotes which the recycler can accept.

The banknote is then fed through a crackle detector 232 in which the banknote is turned through an angle causing the banknote to crackle and this sound is detected by a microphone 233 connected to the controller 208*a*. The detected sound is compared with the sound expected from a genuine banknote paper.

The banknote is then fed into a note positioning module 234 formed by a series of laterally spaced conveyor belts whose positions can be adjusted so as to vary the lateral position of the banknote, if necessary.

The banknote then reaches a diverter 235 of conventional form which can be set to feed the banknote immediately towards an output tray 236 (if the banknote is unacceptable for some reason) or to allow the banknote to be fed on towards a second diverter 237. The diverter 237 can be set to feed the banknote into an escrow store 238 or directed to rollers 239 for conveying the banknote through the aperture 204 in the MSU 202.

The diverter 237 is also able to direct banknotes from the escrow store 238 either back towards the diverter 235 or towards the rollers 239.

The escrow store 238 comprises a roll storage module of conventional form described in more detail in U.S. Pat. No. 4,871,125. The module includes a roll store 241 and a pair of band stores 242.

An output assembly 250 includes the output tray 236 and a stacking wheel 251 rotatable in an anti-clockwise direction, as seen in FIG. 9, to stack banknotes onto the tray 236 as shown at 252.

Figure 15:
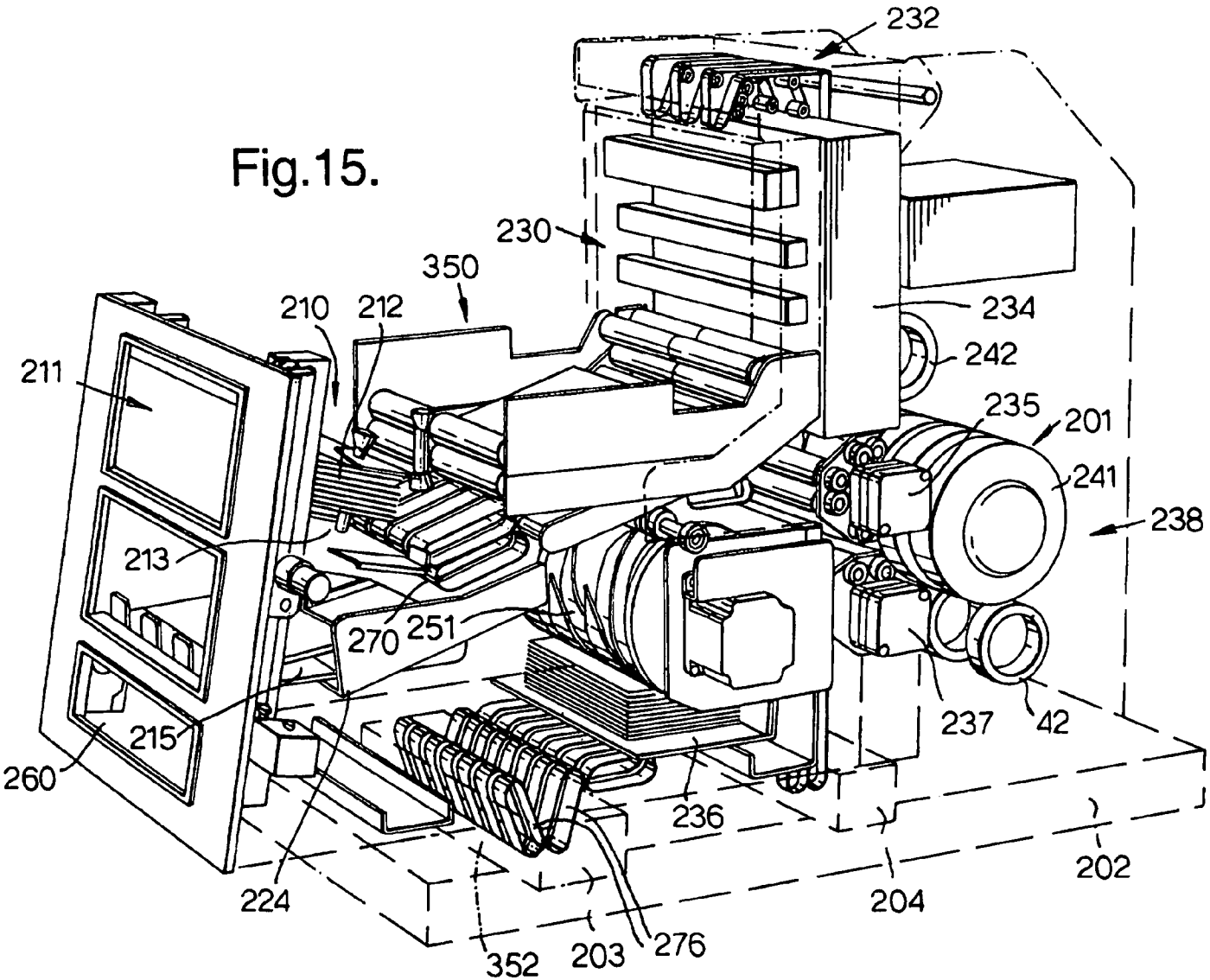
FIGS. 15 and 16 are perspective views of the note handling module in different configurations.

The tray 236 is mounted on laterally spaced tracks (shown schematically at 352 in FIGS. 15 and 16) to enable the tray 236 to be conveyed from the position shown in FIGS. 9 and 15 to an output location 60 (FIGS. 11 and 16) located behind a movable door (not shown) to enable a user to remove the banknotes.

The foreign object location position 215 includes a support plate 270 (FIG. 8) around which are entrained a number of high friction belts 270'. Foreign objects will rest on the plate 270 and if not removed by a user, the plate 270 can be pivoted about pivot 271 between the laterally spaced tracks 352 supporting the tray 236 to the position shown in FIGS. 12 and 16 aligned with a gap 275 between a pair of conveyors 276. The belts 270' can then be activated via rollers on which they are mounted to convey foreign object(s) into the gap 275.

The operation of the sheet recycler will now be described. Initially, the components of the recycler are located in the position shown in FIG. 9. A user will insert a stack of banknotes to be accepted in the input hopper 210 and these will then be fed singly by the transport system via the foreign object conveyor belts 222,223 to the note detector 230. If the note detector 230 and crackle detector 232 determine that the banknotes are acceptable, the diverter 235 will be set appropriately to cause the banknotes to be fed into the escrow store 238. This movement path is indicated by arrow 300 in FIG. 13A.

The controller 208*b* will then display to the user the value of the banknotes it believes are stored in the escrow store 238 and if these are agreed by the user, the banknotes will then be fed out from the roll storage module 238 via the diverter 237 (suitably set) through conveyors 239,240 into the MSU 202 where they will be stored in appropriate roll storage modules 207 according to their value (path 301—FIG. 13C) or into one of the overflow boxes 210.

If the value is not agreed, the banknotes will be fed via diverters 237,235 to the stacking wheel 251 for stacking on the tray 236 and subsequent return to the user.

Figure 13A:
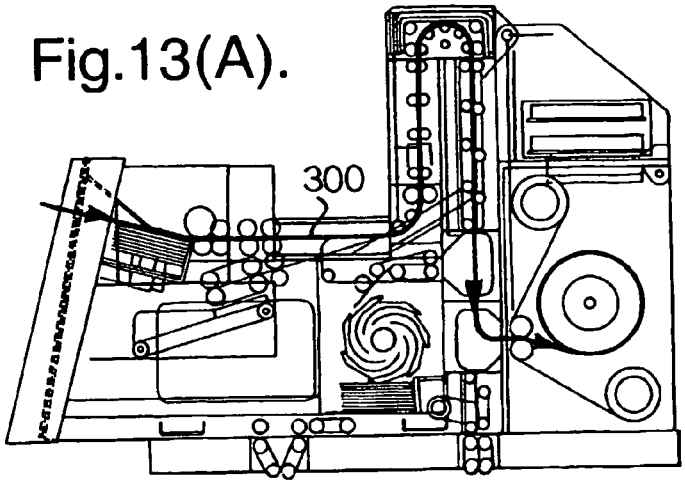
FIGS. 13A–13F illustrate different modes of operation of the recycler.
Figure 13B:
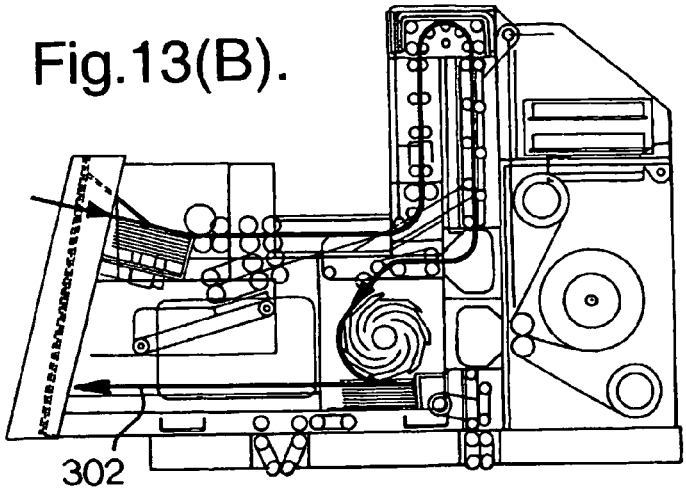
Figure 13C:
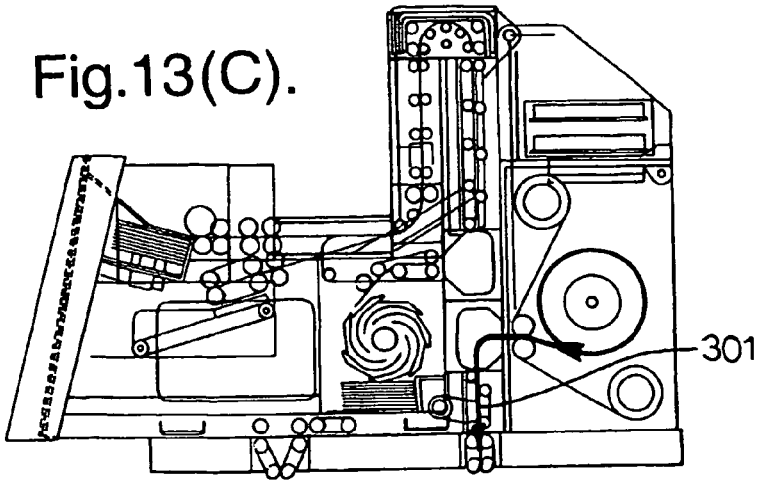
Figure 13D:
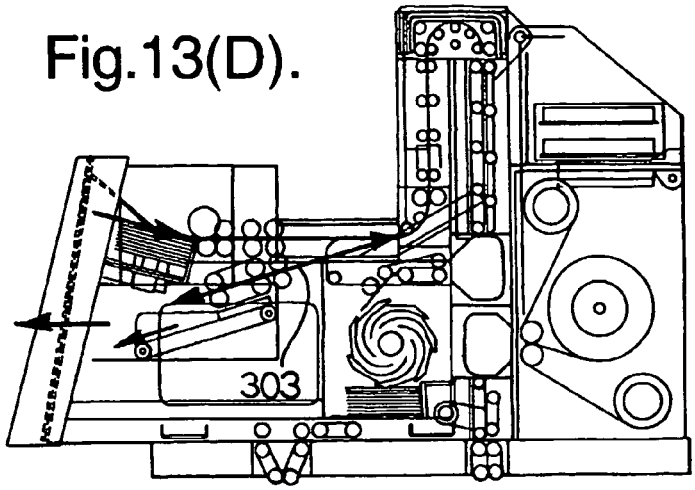
Figure 13E:
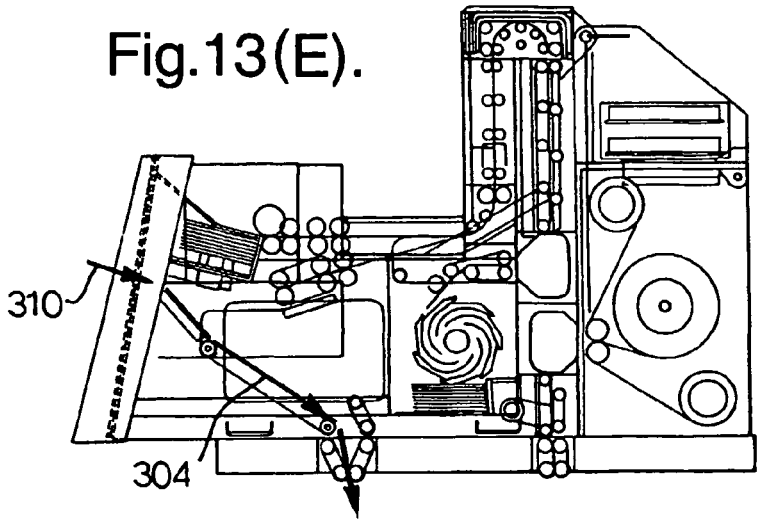
Figure 13F:
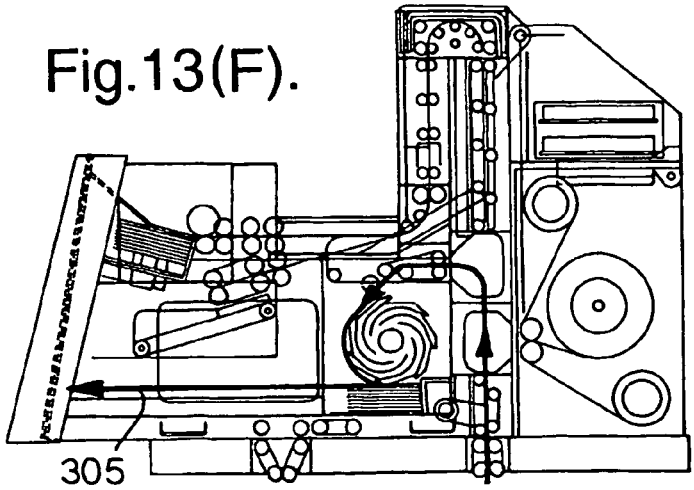

If either of the detectors 230,232 does not recognise the banknote as a valid or acceptable note, the diverter 235 will be set appropriately to feed the banknote to the stacking wheel 251 for stacking on the tray 236 and subsequent return to the user (path 302—FIG. 13B).

If the detector 219 detects a foreign object then this will be fed into the conveyors 222,223 which will then be stopped. The conveyors 222,223 will be pivoted to the position 224 and reversed so that the foreign object and any attached banknote is fed between the conveyors down onto the plate 270 (path 303—FIG. 13D and FIG. 15). The foreign object can then be retrieved by the user. Alternatively, if the foreign object is not retrieved, the plate 270 is pivoted to its reject position and the belts activated to dispense the foreign object into the collection box 205 (path 304—FIG. 13E and FIG. 16).

This latter mode can also be used to allow the apparatus to receive and store items, such as envelopes containing currency. These items are supplied directly to the plate 270 by a user as shown by arrow 310 and then conveyed to the collection box 205 for later, manual processing. The apparatus can thus act like a night safe.

During a dispense operation, once the user has indicated the value of banknotes he wishes to receive and the usual checks have been completed, the controller 208*b* will arrange for the required mix of denominations to be extracted from the appropriate roll storage modules 207 and cassette 208 and be fed by the transport system past diverters 237,235 to the stacking wheel 251 and onto the stacking tray 236. The tray 236 is then moved to the output position 260 to enable the sheets to be removed by the user (path 305—FIG. 13F).

Figure 10:
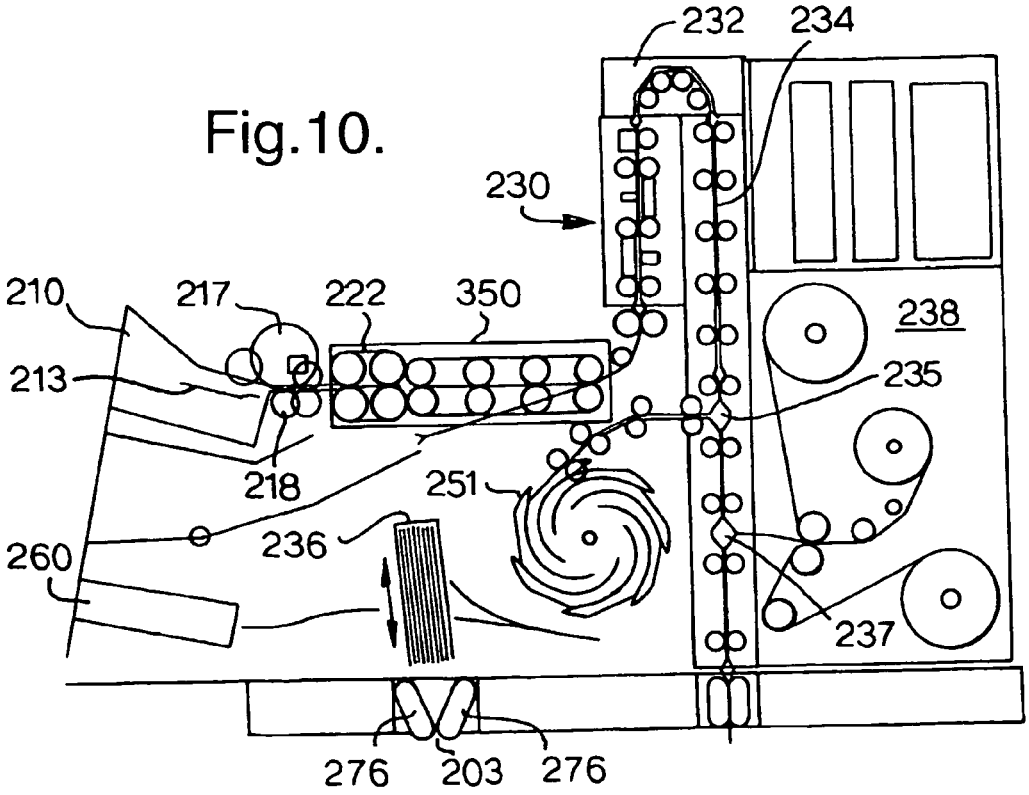
Figure 11:
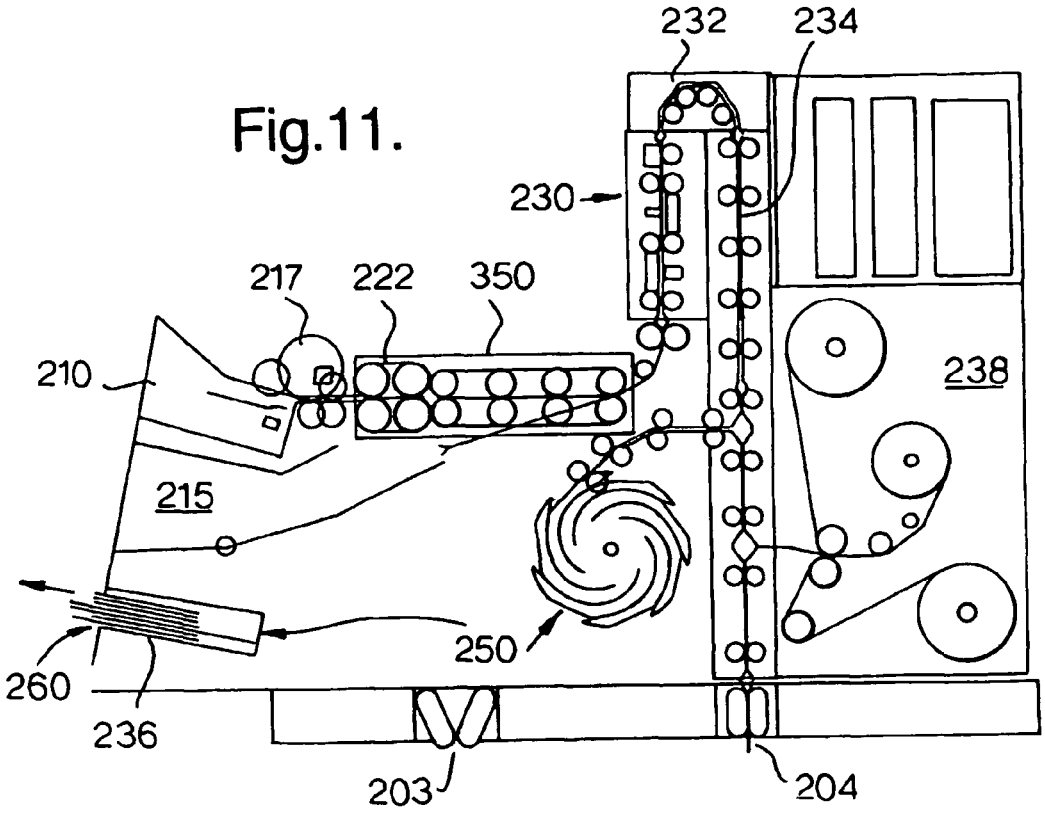
Figure 12:
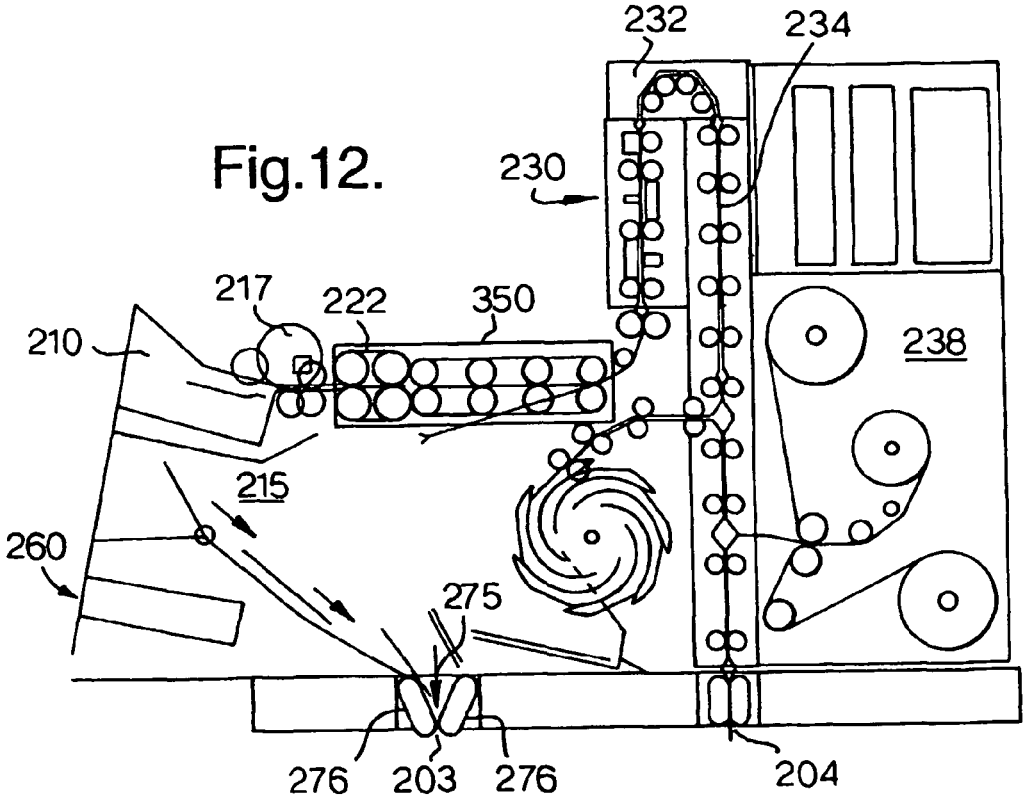

In some cases, the user may fail to take one or more of the stack of banknotes to be dispensed while the tray 236 is at the output position 260. In that event, the system will close the output location door (not shown) and the tray 236 will be retracted to an intermediate position (FIG. 10) at which suitable cams will be actuated to rotate the tray to a substantially vertical position above the conveyers 276. The banknotes will then be fed through the opening 203 into the store 205 (FIG. 10).

Figure 16:
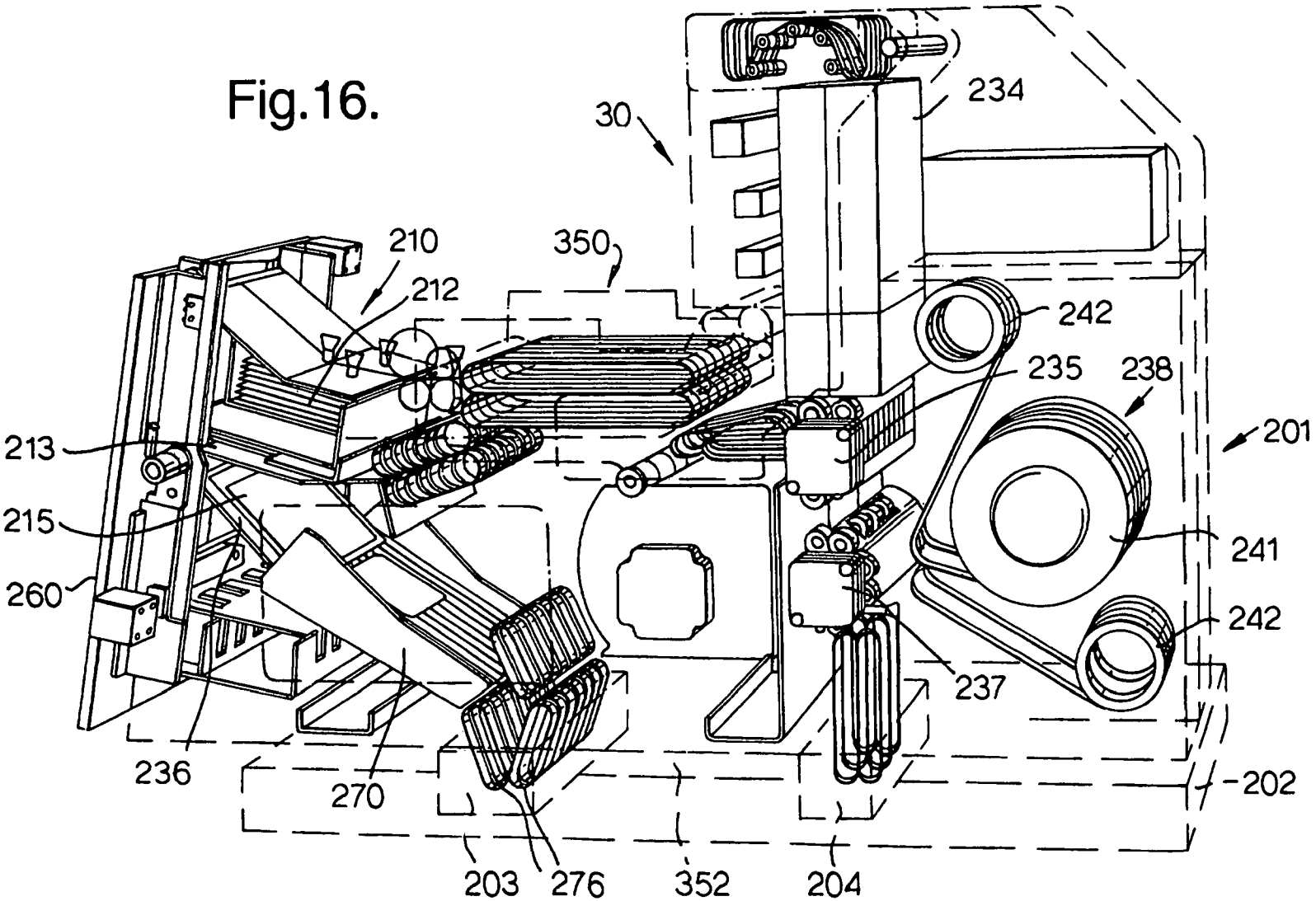

If a jam occurs upstream of the diverter 235, then the transport system can be reversed with the foreign object transport 350 in its position 224 so that the jammed notes are returned to the foreign object collection position 215 for retrieval by the user. If, however, the notes are not retrieved by the user after a predetermined time, then the plate 270 will be pivoted as shown in FIG. 16 so that the notes can be fed down into the store 205.

The invention claimed is:

1. A sheet accepting apparatus comprising an inlet for receiving one or more sheets; a transport system for extracting sheets from the inlet; a first detector for detecting the passage of a foreign object with the transported sheet(s), the transport system being controllable to divert a detected foreign object to a foreign object collection position; one or more further detectors for monitoring sheets fed by the transport system; at least one store for storing accepted sheets; a diverter for diverting unacceptable sheets to an output location; and a controller responsive to the detectors for controlling the transport system.

2. Apparatus according to claim 1, wherein the foreign object collection position is located adjacent the inlet.

3. Apparatus according to claim 1, wherein the inlet is defined by an inlet hopper having at least one opening through which foreign objects can fall into the foreign object collection position.

4. Apparatus according to claim 1, wherein a conveyor system is provided at the foreign object collection position on which foreign objects collect, the conveyor system being operable to feed foreign objects to a secure store.

5. Apparatus according to claim 4, wherein the feed system comprises a conveyor pivoted at one end so as to be movable between a collection orientation and a disposal orientation.

6. Apparatus according to claim 5, wherein the conveyor comprises one or more high friction belts.

7. Apparatus according to claim 1, wherein the one or more further detectors detect one or more of the pattern on a sheet, the size and/or thickness of a sheet, and the stiffness of a sheet.

8. Apparatus according to claim 1, wherein the one or more further detectors are adapted to detect characteristics of banknotes such as limpness or tears.

9. Apparatus according to claim 1, wherein each store comprises a roll storage module, cassette or storage box.

10. Apparatus according to claim 1, wherein, at the inlet, the transport system includes at least one roller defining a feed nip with another surface and which is biased in a direction to close the nip but which can be urged against the bias during passage of a foreign object.

11. Apparatus according to claim 10, wherein the roller can move by more than substantially 3 mm against the bias to accommodate the passage of a foreign object.

12. Apparatus according to claim 1, wherein the output location is provided adjacent the inlet.

13. Apparatus according to claim 1, wherein the transport system defines a first feed system for extracting sheets from the inlet and a second feed system downstream of the first feed system for receiving sheets from the first feed system and for feeding them on to a further downstream location, whereby the second feed system defines a planar path such that foreign objects are substantially not bent as they are fed by the second feed system, the second feed system being pivotally mounted such that when a foreign object is detected, the controller causes the second feed system to pivot so that the foreign object is fed to the foreign object collection position.

14. A sheet recycler, comprising:

the sheet accepting apparatus according to claim 1; and an output assembly to which sheets are fed from the store by the transport system, the output assembly being adapted to present the sheets at an output location.

15. The sheet recycler according to claim 14, wherein the output assembly includes a tray on which the sheets are stacked.

16. The sheet recycler according to claim 15, wherein the tray is movable from a stacking position to an output location.

17. The sheet recycler according to claim 16, wherein the tray is supported on laterally spaced tracks along which it can be moved between the stacking position and the output location.

18. The sheet recycler according to claim 16, wherein the tray is pivotally mounted to enable stacked sheets to be fed into a secure store.

19. The sheet recycler according to claim 18, further comprising a diverting member actuable to cause the tray to pivot during movement of the tray from the output location towards the stacking position.

20. The sheet recycler according to claim 14, further comprising an escrow store to which accepted sheets are initially fed by the transport system.

21. The sheet recycler according to claim 20, wherein the escrow store is provided by a roll storage module.

22. Apparatus according to claim 1, wherein the one or more detectors are provided downstream of the first detector.

23. A sheet accepting apparatus comprising an inlet for receiving one or more sheets; a transport system including a first feed system for extracting sheets from the inlet, the first feed system including a first detector for detecting the passage of a foreign object through the first feed system and a second feed system downstream of the first feed system for receiving sheets from the first feed system and for feeding them on to a further downstream location, whereby the second feed system defines a planar path such that sheets are substantially not bent as they are fed by the second feed system; and a controller connected to the first detector and the second feed system, the second feed system being pivotally mounted such that when a foreign object is detected, the controller causes the second feed system to pivot so that the foreign object is fed to a reject location.

24. Apparatus according to claim 23, wherein the second feed system is pivotally mounted at its downstream end with respect to the first feed system, the controller causing the second feed system to reverse its feed direction when feeding a foreign object to the foreign object collection position.

25. Apparatus according to claim 23, wherein the second feed system comprises juxtaposed feed belts defining a feed path therebetween.

26. Apparatus according to claim 23, wherein the first detector includes at least one roller of the first feed system, and a sensor for monitoring displacement of the at least one roller.

27. Apparatus according to claim 26, wherein the first detector comprises at least two laterally spaced rollers of the first feed system, and respective sensors for monitoring displacement of each roller.

28. Apparatus according to claim 27, wherein the controller is adapted to determine differences in the amounts by which the rollers are displaced so as to indicate the presence of a foreign object.

* * * * *